US007047660B2

(12) United States Patent
Leventhal

(10) Patent No.: US 7,047,660 B2
(45) Date of Patent: May 23, 2006

(54) HAIR DRYER ATTACHMENT

(75) Inventor: James M. Leventhal, Newton Centre, MA (US)

(73) Assignee: Clio Designs Incorporated, Watertown, MA (US)

( * ) Notice: Subject to any disclaimer, the term of this patent is extended or adjusted under 35 U.S.C. 154(b) by 0 days.

(21) Appl. No.: 10/967,440

(22) Filed: Oct. 18, 2004

(65) Prior Publication Data

US 2005/0108889 A1 May 26, 2005

Related U.S. Application Data

(60) Provisional application No. 60/512,258, filed on Oct. 17, 2003.

(51) Int. Cl.
*A45D 20/12* (2006.01)

(52) U.S. Cl. ..... 34/97

(58) Field of Classification Search ..... 34/96, 34/97, 98, 99, 100; 132/116
See application file for complete search history.

(56) References Cited

U.S. PATENT DOCUMENTS 3,892,247 A * 7/1975 Andersen ..... 132/148
5,612,849 A * 3/1997 Prehodka et al. ..... 361/213
5,975,090 A * 11/1999 Taylor et al. ..... 132/116
2002/0189128 A1* 12/2002 Nakagawa et al. ..... 34/96
2003/0084586 A1* 5/2003 Lo ..... 34/96
2003/0152373 A1* 8/2003 Wong et al. ..... 392/385

* cited by examiner

*Primary Examiner*—S. Gravini
(74) *Attorney, Agent, or Firm*—Mintz, Levin, Cohn, Ferris, Glovsky and Popeo, P.C.

(57) ABSTRACT

An attachment to a hair dryer is provided including a housing, an ion generator system, and a control box to contain the ion generator system. The housing removably couples to a hair dryer along an air-venting portion of the dryer. The attachment includes a fitting device to enable the attachment to be securely and releasably coupled with any of a variety of hair dryer designs. The ion generator system includes a high-voltage module that generates and emits ions and/or ozone into a stream of air generated by and within the hair dryer. The ion generator includes an ion release configured to deliver ions and/or ozone emitted from the module into a stream of air such that ions and/or ozone become entrained and flow with air from the hair dryer. The ion generator system may further include an actuator switch and a power source operatively coupled to the high-voltage module to control its operation.

25 Claims, 4 Drawing Sheets

HAIR DRYER ATTACHMENT

RELATED PATENT APPLICATION

This application is a nonprovisional application which claims priority to provisional application Ser. No. 60/512,258, filed Oct. 17, 2003, the entirety of which is incorporated herein by reference.

FIELD OF THE INVENTION

The invention relates to a hair dryer attachment.

BACKGROUND OF THE INVENTION

It is well known that hair can be electrically insulating and thus brushing, combing and/or drying hair can produce a static electrical charge. This is generally considered undesirable because statically charged hair can be difficult to style and set and can make hair unruly. Statically charged hair can also attract airborne dust and dirt, which is also generally considered undesirable. It is also well known that static electricity can often be difficult to remove once it is generated and stored in the hair. To counter these undesirable effects, it is widely accepted that the use of ions and/or ozone in the hair drying and styling process can provide several benefits, including the neutralization or elimination of static electricity in the hair.

Prior art hair dryers include conventional, radiant-heat hair dryers designed to deliver heat with the use of a fan powered by electricity. These conventional hair dryers, however, do not produce or emit ions or ozone to neutralize or eliminate static electricity in the hair. As a result, new "ionic" hair dryers have been developed which incorporate a device that produces and emits ions, typically negative ions, and/or ozone into the hair during the hair drying process. These new "ionic" hair dryers, however, require the consumer to put aside their currently operational, conventional hair dryer and purchase a separate, new hair dryer. This can be a costly, wasteful and inefficient exercise for most consumers, as their existing, conventional hair dryer may still have many years of reliable service. Therefore, many people may choose either to spend substantially to replace their usable, functional conventional hair dryer or opt simply to pass altogether on the new ionic technology available in hair dryers.

SUMMARY OF THE INVENTION

In general, in one aspect, the invention provides an attachment to a hair dryer comprising an ion generator system having a housing that couples with or connects to a conventional hair dryer to produce ions and/or ozone and to deliver the ions and/or ozone into an air stream produced by the hair dryer. The hair dryer attachment, in one configuration, is configured for removable connection or coupling to a hair dryer.

Various aspects of the invention may provide one or more of the following capabilities. A hair dryer attachment allows a user to experience the benefits of ionic technology without the need to replace a usable, functional hair dryer. An ion and/or ozone-generating hair dryer attachment also eliminates the need for a user to purchase a new "ionic" hair dryer. In addition, such hair dryer attachment may be constructed of lightweight materials and thereby may offer the benefits of portability. Further, such hair dryer attachment is configured for use with a variety of hair dryer designs.

These and other capabilities of the invention, along with the invention itself, will be more fully understood after a review of the following figures, detailed description, and claims.

DETAILED DESCRIPTION OF PREFERRED EMBODIMENTS

Embodiments of the present invention provide an attachment to a hair dryer. The hair dryer attachment according to the invention includes a housing that couples with or connects to a conventional hair dryer, and further includes an ion generator system.

Figure 1:
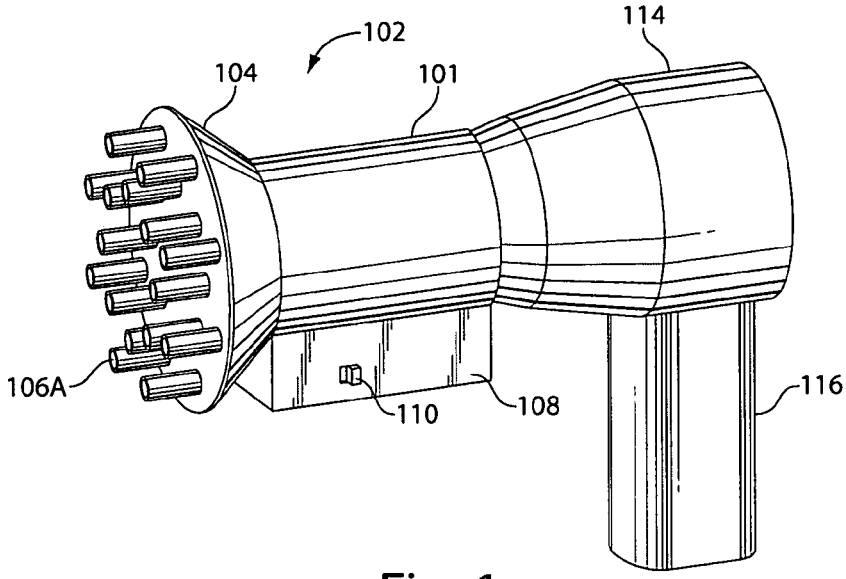
FIG. 1 is a perspective view of a hair dryer attachment according to one aspect of the invention, coupled to a conventional hair dryer.
Figure 2:
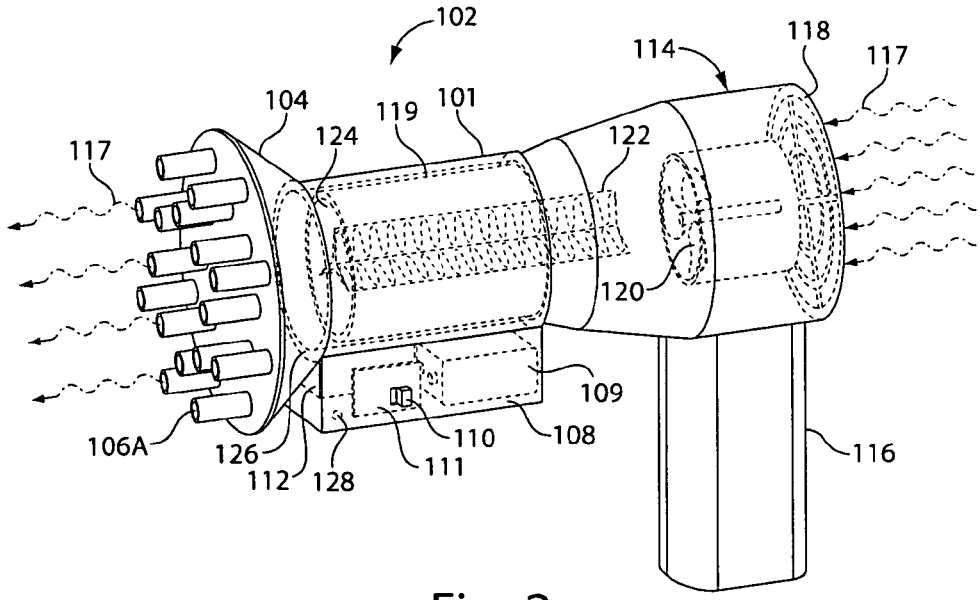
FIG. 2 is a perspective view of the hair dryer attachment shown in FIG. 1, coupled to a conventional hair dryer with an outer enclosure made transparent for purposes of illustrating an interior arrangement.

Referring to FIGS. 1 and 2, in an aspect, the invention provides a hair dryer attachment 102 including an ion generator system. The attachment 102 is constructed and arranged to couple with or to connect to a conventional hair dryer 114. In particular, the attachment 102 is configured for removable coupling or connection with the hair dryer 114. The attachment 102 further includes a housing 101 and a control box 108 configured to contain the ion generator system. Other embodiments are within the scope of the invention.

As shown in FIG. 2, the ion generator system is disposed within the control box 108 and includes a high-voltage module 112 configured to generate and emit ions and/or ozone. The production of ions by the high-voltage module 112 generates an amount of ozone that is a by-product of ion production. Therefore, the high-voltage module 112 may be configured to generate and emit ions and, as a by-product of ion production, also produces an amount of ozone. Alternatively, or in addition, the high-voltage module 112 may be configured to generate ozone and ions as primary products either alone or simultaneously during operation of the high-voltage module 112.

The ion generator system further includes an actuator switch 110 coupled to the module 112, and a power source 109 disposed within the control box 108 to operatively couple with the switch 110 and/or the module 112. The ion generator system may further include a point source ion release 126 disposed within the control box 108 and configured to release ions into an air stream 117 generated by and within the hair dryer 114. The attachment 102 may also include a diffuser or air concentrator portion 104 configured to help to direct and to concentrate an air stream 117 emitted from the hair dryer 114. The concentrator portion 104 can define any configuration or shape to help to direct and concentrate air, and, in particular, preferably defines a conical or cone-shape.

Figure 3:
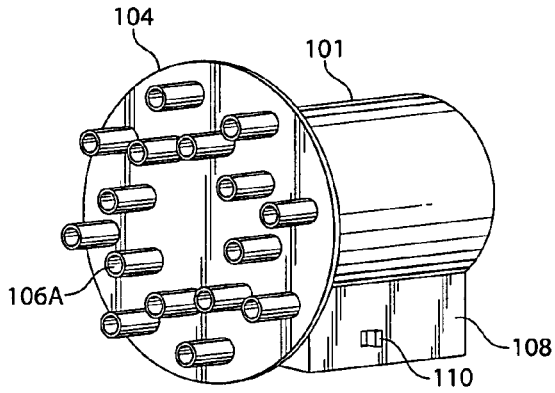
FIG. 3 is a perspective view of a front portion of the hair dryer attachment shown in FIG. 1.
Figure 4:
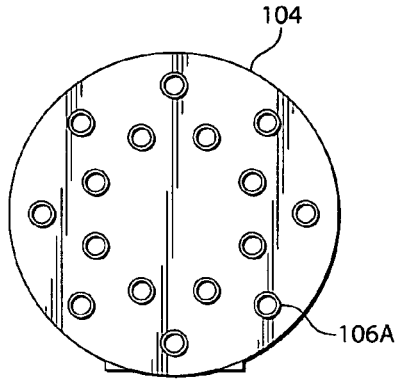
FIG. 4 is a front view of the hair dryer attachment shown in FIG. 1.

Referring to FIGS. 3 and 4, and with further reference to FIGS. 1 and 2, the diffuser or air concentrator portion 104 has a plurality of through holes 106A defined therein. Each through hole 106A is configured to vent air generated from the hair dryer 114 or from an air exit 124 of the dryer 114, and to vent air through the through hole 106A to an area external to the attachment 102.

With further reference to FIG. 2, the hair dryer 114 may include a conventionally designed hair dryer that defines, for instance, barrel-shaped nozzle 119 and includes an air intake area 118, a fan 120 and a heating element 122. The fan 120 is disposed within the hair dryer 114 and is configured to draw air 117 from an area external to the hair dryer 114 through the air intake area 118 into an interior of the hair dryer 114. The air intake area 118 is configured to help to permit air 117 to be pulled into the hair dryer 114 by the fan 120. The fan 120 is further configured to force drawn-in air 117 contained within its interior, e.g., within its blades, from its interior and past or through the heating element 122. The heating element 122 is disposed within the hair dryer 114 at a position anterior or distal to the fan 120. The fan 120 forces drawn-in air 117 outward from within its interior with sufficient force to help to vent air 117 past or through the heating element 122 and through the plurality of through holes 106A.

With further reference to FIGS. 3 and 4, in one configuration, the plurality of through holes may include one or more projections 106A as shown. Each projection 106A is configured to concentrate and to deliver air 117 vented from within the hair dryer 114. The one or more projections 106A may be cylindrical, although other geometric shapes and forms, such as conical or cone shape, are contemplated and are within the scope of the invention. Alternatively, the plurality of through holes 106A may be configured as apertures or openings defined in a plate or surface (not shown) disposed at an end of the diffuser or air concentrator portion 104 that vents air 117 to an area external to the attachment 102.

Figure 5:
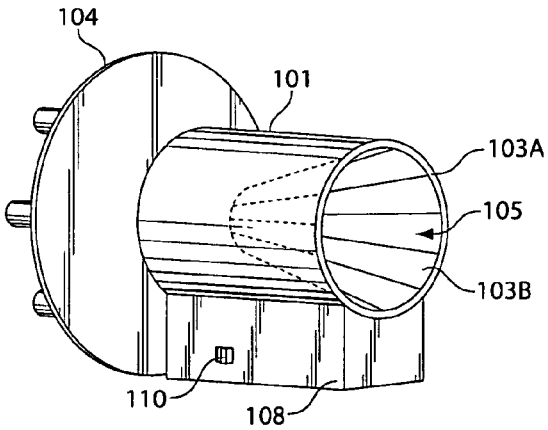
FIG. 5 is a perspective view of a rear portion of the hair dryer attachment shown in FIG. 1.
Figure 6:
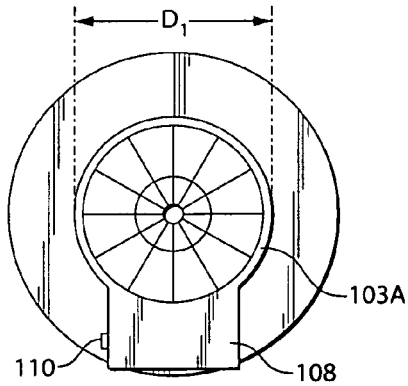
FIG. 6 is a rear view of the hair dryer attachment shown in FIG. 1.

Referring to FIGS. 5 and 6, and with further reference to FIG. 2, a rear portion 103A of the attachment 102, opposite to the plurality of through holes 106A, defines an opening 105 configured to receive at least a portion of the nozzle 119 of the hair dryer 114. The rear portion 103A is further configured to help to contain or to hold the portion of the nozzle 119 in place when the attachment 102 is coupled with or connected to the hair dryer 114. The opening 105 of the rear portion 103A may define a diameter D1 that measures slightly larger than a diameter of the nozzle 119 to help to produce a secure coupling of the attachment 102 to the nozzle.

In one configuration, the rear portion 103A of the attachment 102 can further include a fitting device 103B disposed and configured to help to adapt the rear portion 103A of the attachment 102 to receive at least a portion of the nozzle 119 and to hold the nozzle 119 in position, e.g., securely and releasably, during use of the hair dryer 114. The rear portion 103A, as described above, or the fitting device 103B is disposed and configured such that where the nozzle 119 is inserted into the rear portion 103A or the fitting device 103B, the attachment 102 or the fitting device 103B accepts at least a portion of the nozzle 119. The rear portion 103A and the fitting device 103B may be further configured to position at least a portion of the nozzle 119 proximate to the ion release 126 when the attachment 102 is coupled to the hair dryer 114, as will be discussed below in more detail.

In another configuration, the fitting device 103B can be configured and/or can be constructed of materials suitable to permit the fitting device 103B to accept different sized and shaped nozzles 119 of hair dryers to thereby enable the attachment 102 to be used with any of a variety of hair dryer designs.

With further reference to FIG. 2, the control box 108 contains the ion generator system. In one configuration, the ion generator system is an integrated system including, but not limited to, the actuator switch 110 disposed along an outer surface of the control box 108, the power source 109, and the high-voltage module 112. As noted above, the ion generator system may further include the point source ion release 126, e.g., a pin or needle-shaped device, operatively coupled with the ion generator system and positioned within the control box 108 to introduce ions emitted from the high-voltage module 112 into a stream of air 117 generated from within the hair dryer 114. In one configuration, the ion release 126 is connected to the high-voltage module 112 to receive ions emitted from the module 112.

The power source 109 may include a direct current source, such as a rechargeable battery. Alternatively, or in addition, the attachment 102 may include a connection, e.g., disposed along an exterior surface of the housing 101 and operatively coupled to the high-voltage module 112, to connect the attachment 102 to an external current source, such as an electric power source.

The ion generator system may further include an LED indicator or display 128 disposed along the exterior surface of the housing 101. The LED indicator 128 may be operatively connected to the high-voltage module 112 and/or a printed circuit board (PCB) 111, as discussed below, such that the LED indicator receives an indicator signal transmitted from the ion generator system and displays the signal to indicate a mode of operation of the system.

With further reference to FIG. 2, the actuator switch 110 is disposed along an outer surface of the control box 108 and is configured such that it is accessible from an area external to the attachment 102 for actuation of the ion generator system. In one configuration, the actuator switch 110 may be disposed and configured such that it is operatively coupled with the power source 109 and/or the high-voltage module 112 to effect generation and release of ions from the high-voltage module 112. When the actuator switch 110 is actuated, e.g., depressed, the high-voltage module 112 becomes actuated or deactuated to initiate generation and emission of ions from the high-voltage module 112 and through the ion release 126.

With further reference to FIG. 2, the ion generator system may further include a printed circuit board (PCB) 111 to control operation and various functions of the ion generator system. The PCB 111 is operatively coupled to the actuator switch 110, the power source 109 and/or the high-voltage module 112 such that actuation or deactuation, e.g., depression, of the switch 110, for instance, operatively couples the power source 109 to the PCB 111 and helps to initiate or terminate operation of the module 112. In one configuration, the PCB 111 controls flow of electric current to the switch 110 to thereby actuate/deactuate operation of the high-voltage module 112. Further, the PCB 111 may be operatively couple to the LED 128 and control flow of electric current to the LED 128

The invention is not limited to the components and electronics as specifically described herein and anticipates that other integrated electrical circuits may be employed to control the high-voltage module 112 to generate and emit ions as required.

With further reference to FIGS. 2, 5, and 6, the ion release 126 is disposed proximate to the open distal end or air exit 124 of the hair dryer 114 to permit the ion release 126 to deliver ions into a stream of air 117 generated by the hair dryer 114 before the stream of air 117 vents from the hair dryer 114. In another configuration, the rear portion 103A of the attachment 102 or the fitting device 103B are disposed and configured such that when the attachment 102 is coupled with or connected to a portion of the nozzle 119, the nozzle 119 is positioned such that ions released from the ion release 126 become entrained in a stream of air 117 before the stream of air 117 vents from the air exit 124 of the hair dryer 114. Other arrangements and positions of the ion release 126 are envisioned to supply ions and/or ozone to stream of air 117 generated by the hair dryer 114.

With further reference to FIG. 2, operation of the hair dryer 114 with the attachment 102 according to the invention is described. When operable, the fan 120 of the hair dryer 114 draws air 117 into the air intake area 118 and forces drawn-in air 117 into an interior of the fan 120. The fan 120 then forces air from its interior, e.g., blades, and past or through the heating element 122. The air 117 is heated as it is forced past or through the heating element 122 via convection heating. Heated air 117 is thereafter vented from the hair dryer 114 at the open distal end or air exit 124 of the nozzle 119. Heated air 117 forced through the open distal end or air exit 124 enters an interior of the attachment 102 and flows proximate to and past the ion release 126. As heated air 117 flows past the ion release 126, ions emitted from the ion release 126 are delivered into the heated air 117 and thereby become entrained by flow of heated air 117. Heated air 117 is thereafter vented from the attachment 102 through the plurality of through holes 106A and vents to an exterior of the housing 101 to impact a user's hair. The attachment 102 according to the invention thereby delivers ions, e.g., negative or positive, and/or ozone to a user's hair during use of the hair dryer 114.

Figure 7:
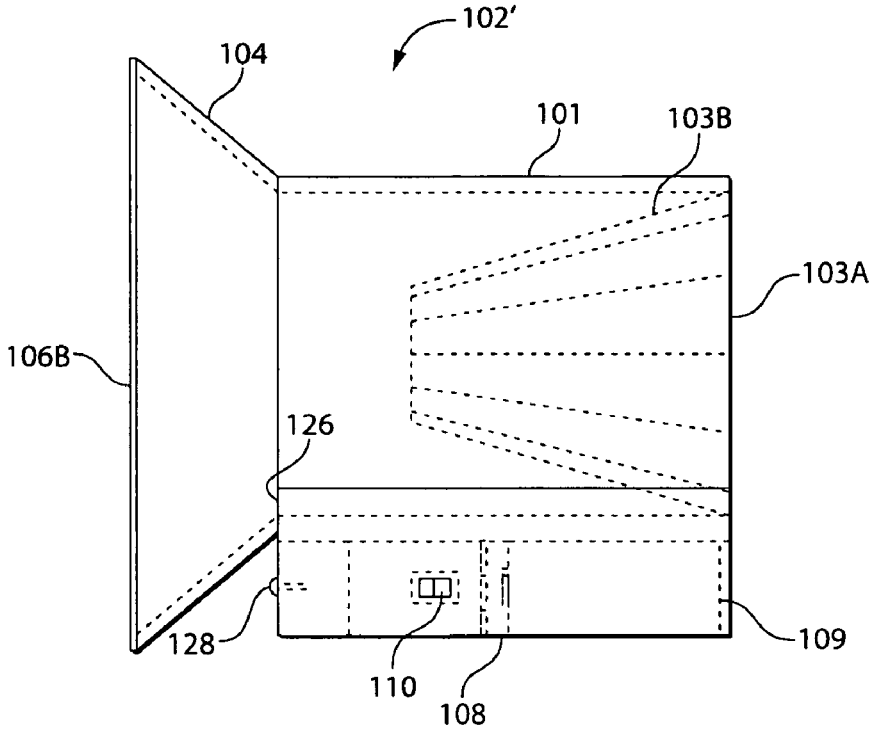
FIG. 7 is a side view of a hair dryer attachment according to another aspect of the invention, with an outer enclosure made transparent for purposes of illustrating an interior arrangement.
Figure 8:
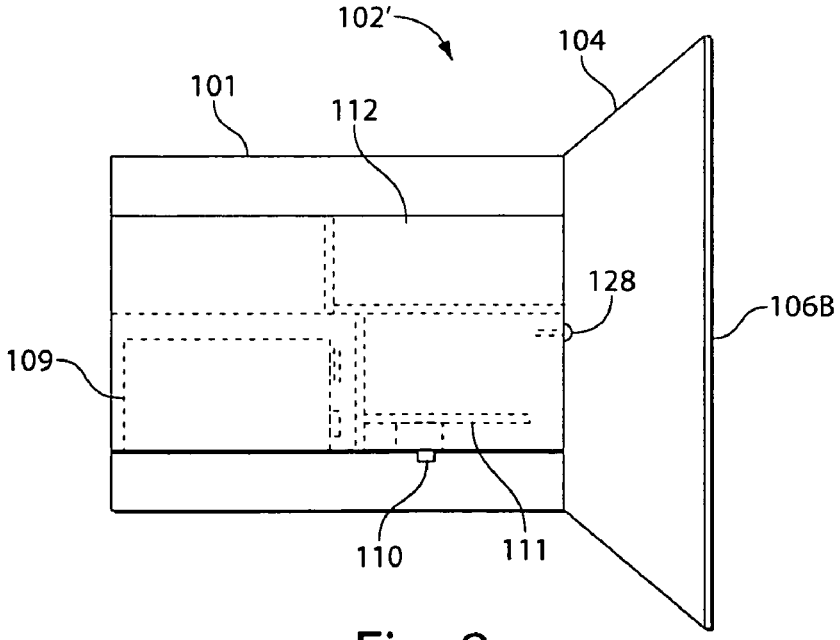
FIG. 8 is a bottom view of the hair dryer attachment shown in FIG. 7, with the outer enclosure made transparent for purposes of illustrating an interior arrangement.

Referring to FIGS. 7 and 8, and with further reference to FIG. 2, in another aspect, the invention provides a hair dryer attachment 102' including substantially all of the components as described above with reference to FIGS. 1–6, and further including a diffuser or air concentrator portion 104 having an open terminal end or an open air channel 106B to vent air 117 from the hair dryer 114 via the attachment 102'. The open air channel 106B may be configured to conform air 117 venting from the attachment 102 as a substantially continuous pattern or stream of air 117. In one configuration, the open air channel 106B, and/or the diffuser or air concentrator portion 104, can be configured to accept one or more other attachments configured as a diffuser (not shown) or as a concentrator (not shown) to diffuse or to concentrate air 117 while it vents from the attachment 102.

Figure 9A:
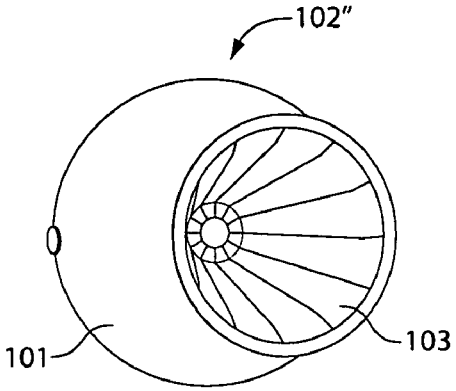
FIGS. 9A–9D are perspective views of a hair dryer attachment according to another aspect of the invention.
Figure 9B:
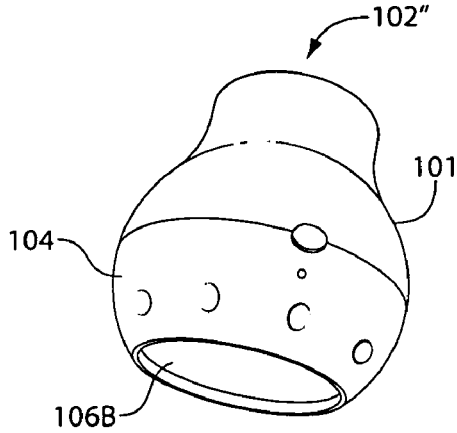
Figure 9C:
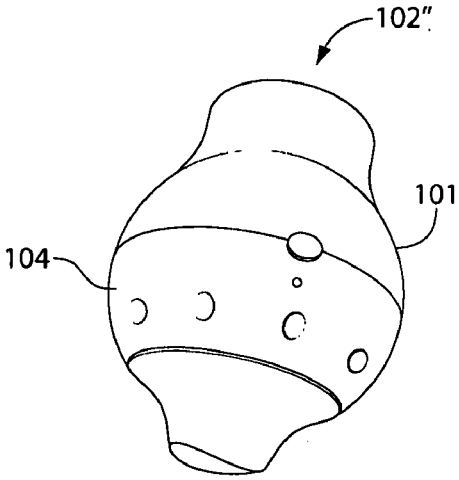
Figure 9D:
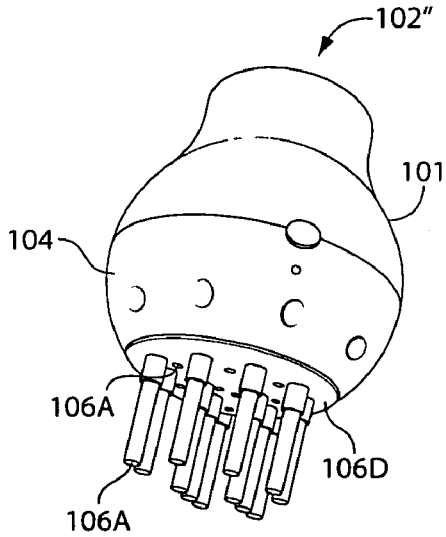

Referring to FIGS. 9A–9D, in another aspect, the invention provides a hair dryer attachment 102" including substantially all of the components of the attachment 102 and 102'as described above with reference to FIGS. 1–6, and further including alternate configurations or shapes. As shown in FIGS. 9B–9D, the attachment 102" includes the housing 101 and the air diffuser or concentrator portion 104 with a curved conformation. As shown in FIG. 9C, the opening 106B of the diffuser or concentrator 104 is configured to couple to or to mate with a concentrating nozzle 106C configured to concentrate and/or direct a stream of air vented from the attachment 102". As shown in FIG. 9D, the opening 106B is configured to couple to or to mate with the plurality of through holes 106A. In addition, in a further configuration of the attachment 102" shown in FIG. 9D, the plurality of through holes 106A may emanate from a plate 106D in which additional through holes or apertures are defined. The invention is not limited to the configuration or shape of the attachment 102" as shown in FIGS. 9A–9B and anticipates that the attachment 102" may be formed in other configurations and shapes.

The attachment 102, 102' and 102" according to the invention may be constructed of one or more materials suitable for providing the attachment 102, 102' and 102" as a lightweight and portable device. In addition, other suitable materials include materials that can withstand exposure to moisture, water, hair products, ions and ozone. In particular, the fitting device 103B may be constructed of one or more materials suitable for imparting deflection properties, flexibility or compression capabilities to the fitting device 103B such that the fitting device 103B can respond to an application of force or pressure exerted upon it through contact with the portion of the nozzle 119 when the portion of the nozzle 119 is inserted into the fitting device 103B to removably connect the attachment 102 to the hair dryer 114. Such materials include, but are not limited to, plastic, rubber, metal and any combinations of such materials.

The hair dryer attachment 102, 102' and 102" is described primarily herein with reference to generation of ions; however, those of ordinary skill in the art will appreciate that the attachment 102, 102' and 102" may be configured to emit negative and/or positive ions, as well as ozone either alone or in conjunction with ions. As noted above, a volume of ozone can be generated from the high-voltage module 112 as a consequential by-product of the generation of ions within the module 112.

Having thus described at least one illustrative embodiment of the invention, various alterations, modifications and improvements will readily occur to those skilled in the art. Such alterations, modifications and improvements are intended to be within the scope and spirit of the invention. Accordingly, the foregoing description is by way of example only and is not intended as limiting. The invention's limit is defined only in the following claims and the equivalents thereto:

What is claimed is:

1. A hair dryer attachment comprising:

a housing defining an interior chamber, the interior chamber defining along a first end of the housing a first opening;

a fitting device disposed along the first opening, the fitting device being configured and arranged to releasably connect to at least part of a venting portion of a hair dryer and being further constructed to adjustably accommodate at least one of a shape and a size of the at least part of the venting portion of the hair dryer, the venting portion including at least one opening for venting air from an interior portion of the hair dryer to an area external to the hair dryer; and a control box coupled to the housing and constructed and arranged to contain an ion generator system, the ion generator system being configured and disposed to generate and to emit at least one of ions and ozone into the air vented through the opening of the venting portion of the hair dryer.

2. The hair dryer attachment of claim 1 wherein the ion generator system includes a high-voltage module configured to generate and to emit at least one of ions and ozone, a power source operatively coupled to the high-voltage module, and an actuator switch operatively coupled to the power source.

3. The hair dryer attachment of claim 2 wherein the ion generator system further includes a printed circuit board, the printed circuit board being configured to control flow of electric power to one of the actuator switch and the high-voltage module.

4. The hair dryer attachment of claim 2 wherein the ion generator system further includes an ion release module operatively coupled to the high-voltage module and is further disposed within the control box to release at least one of ions and ozone which the high-voltage module emits.

5. The hair dryer attachment of claim 1 wherein the ion generator system includes a high-voltage module configured to generate and emit one of ions and ozone, and an ion release module, each disposed within the control box, the ion release module being operatively coupled to the high-voltage module and being configured to release at least one of ions and ozone which the high-voltage module emits.

6. The hair dryer attachment of claim 3 wherein the ion release module is further disposed within the control box to deliver at least one of emitted ions and emitted ozone into a stream of air generated by and within a hair dryer when the hair dryer attachment is connected to the hair dryer.

7. The hair dryer attachment of claim 3 wherein the ion release module is further disposed within the control box such that at least one of ions and ozone emitted from the ion release module are entrained in a stream of air generated by and within a hair dryer when the hair dryer attachment is connected to the hair dryer.

8. The hair dryer attachment of claim 3 wherein the ion release module is configured as a needle-shaped release.

9. The hair dryer attachment of claim 2 wherein at least a portion of the actuator switch is disposed along a surface of the control box to operatively couple the actuator switch to the high voltage module and to permit access to the actuator switch from an area external to the control box.

10. The hair dryer attachment of claim 9 wherein the actuator switch is configured such that actuation of the actuator switch causes at least one of starts operation and ends operation of the high-voltage module.

11. The hair dryer attachment of claim 2 wherein the high-voltage module is configured to produce at least one of positive ions and negative ions.

12. The hair dryer attachment of claim 1 wherein at least a portion of the fitting device is configured in a cone-shape.

13. The hair dryer attachment of claim 1 further comprising an air concentrator constructed and arranged along a first open end to releasably connect to a second opening defined along a second end of the housing opposite to the first end, the air concentrator including a plurality of through holes disposed along a second closed end such that the plurality of through holes is in fluid communication with the interior chamber of the housing, each through hole being disposed and configured to receive air vented from the at least one opening of the venting portion of the hair dryer and to vent air from the housing and the air concentrator.

14. The hair dryer attachment of claim 13 further comprising a plurality of air tubes disposed along the second closed end of the air concentrator, each air tube coupled to one of the through holes, each air tube being disposed and configured to receive air vented from the venting portion of the hair dryer and to vent air from the housing and the air concentrator.

15. The hair dryer attachment of claim 1 further comprising an air diffuser releasably connectable a second opening defined along a second end of the housing opposite to the first end of the housing, the air diffuser being disposed and configured to receive air from the at least one opening of the venting portion of the hair dryer and to vent air from the hair dryer attachment.

16. The hair dryer attachment of claim 2 further comprising an LED indicator disposed along an external surface of the housing and operatively connected to the high-voltage module, wherein the LED indicator is configured to receive and to display an indicator signal transmitted from the high-voltage module to the LED indicator, wherein the indicator signal indicates a mode of operation of the high-voltage module.

17. The hair dryer attachment of claim 2 wherein the power source includes a rechargeable battery.

18. The hair dryer attachment of claim 2 wherein the power source includes a connection disposed along the control box for connection to an external electric power source.

19. A hair dryer attachment comprising:

a housing defining an interior chamber, the interior chamber defining along a first end of the housing a first opening;

a fitting device disposed along the first opening, the fitting device being configured and arranged to releasably connect to at least part of a venting portion of a hair dryer and being further constructed to adjustably accommodate at least one of a shape and a size of the at least part of the venting portion of the hair dryer, the venting portion including at least one opening for venting air from an interior portion of the hair dryer to an area external to the hair dryer;

means disposed within an interior of the housing for generating and emitting at least one of ions and ozone;

means disposed within the interior of the housing for delivering at least one of ions and ozone into a stream of air generated by and within the hair dryer to entrain at least one of ions and ozone within the stream of air; and means to supply power operatively coupled to means for generating and emitting at least one of ions and ozone.

20. The hair dryer attachment of claim 19, wherein means for generating and emitting at least one of ions and ozone includes a high-voltage module.

21. The hair dryer attachment of claim 19, wherein means for delivering at least one of ions and ozone into a stream of air includes an ion release module operatively coupled to means for generating and emitting at least one of ions and ozone.

22. The hair dryer attachment of claim 19 wherein means to supply power includes a battery operatively coupled to means for generating and emitting at least one of ions and ozone.

23. The hair dryer attachment of claim 22 further including means to operatively couple the battery with means for generating and emitting at least one of ions and ozone.

24. The hair dryer attachment of claim 23 wherein means to operatively couple the battery with means for generating and emitting at least one of ions and ozone includes a printed circuit board.

25. The hair dryer attachment of claim 19 further including means coupled to the housing and configured to receive the stream of air from the hair dryer and to vent the stream of air from the hair dryer attachment.

* * * * *